United States Patent [19]

Hambleton et al.

[11] Patent Number: 4,606,454

[45] Date of Patent: Aug. 19, 1986

[54] PROTECTIVE PACKAGING SYSTEM FOR A PLURALITY OF CONTAINERS

[76] Inventors: Thomas P. Hambleton, R.D. 1, Box 522, Pine Bush, N.Y. 12566; Harold F. Tighe, Jr., 142 N. Beacon St.; John J. Michels, Apt. 30-D Rockwood Garden Apartments, both of Middletown, N.Y. 10940

[21] Appl. No.: 659,634

[22] Filed: Oct. 11, 1984

[51] Int. Cl.[4] ..... B65D 75/00

[52] U.S. Cl. ..... 206/150; 206/147; 206/432

[58] Field of Search ..... 206/147–150, 206/151, 432, 431

[56] References Cited

U.S. PATENT DOCUMENTS

| | | | |
|---|---|---|---|
| D. 265,979 | 8/1982 | Arfert . | |
| D. 270,428 | 9/1983 | Arfert . | |
| 2,680,040 | 6/1954 | Gribskov et al. | 206/431 |
| 3,062,373 | 11/1962 | Reynolds . | |
| 3,118,537 | 1/1964 | Copping . | |
| 3,200,944 | 8/1965 | Rapata . | |
| 3,202,448 | 8/1965 | Stern et al. . | |
| 3,219,183 | 11/1965 | Potter et al. | 206/432 |
| 3,224,575 | 12/1965 | Whiteford . | |
| 3,224,576 | 12/1965 | Whiteford . | |
| 3,242,631 | 3/1966 | Whiteford . | |
| 3,286,833 | 11/1966 | Chadbourne . | |
| 3,300,041 | 1/1967 | Fuller . | |
| 3,331,500 | 7/1967 | Poupitch . | |
| 3,331,502 | 7/1967 | Stroop et al. . | |
| 3,338,406 | 8/1967 | Anderson . | |
| 3,346,106 | 10/1967 | Gooding . | |
| 3,350,131 | 10/1967 | Tanzer . | |
| 3,355,013 | 11/1967 | Poupitch | 206/150 |
| 3,384,229 | 5/1968 | Kaschyk et al. | 206/432 |
| 3,476,237 | 11/1969 | Kirby, Jr. | 206/432 |
| 3,515,272 | 6/1970 | Von Gal . | |
| 3,624,776 | 11/1971 | Gorden . | |
| 3,650,395 | 3/1972 | Hobbs . | |
| 3,709,325 | 1/1973 | Gorden et al. . | |
| 3,784,002 | 1/1974 | Owen . | |
| 3,804,234 | 4/1974 | Gordon . | |
| 3,871,669 | 3/1975 | Hatfield . | |
| 3,884,354 | 5/1975 | Guenther et al. | 206/147 |
| 4,116,331 | 9/1978 | Curry et al. . | |
| 4,213,529 | 7/1980 | Whitaker | 206/431 |
| 4,300,681 | 11/1981 | Klygis et al. | 206/432 |
| 4,441,611 | 4/1984 | Sommariva | 206/431 |

*Primary Examiner*—Joseph Man-Fu Moy

[57] ABSTRACT

The present invention is a protective packaging system for a plurality of containers (12) having a top protective cover (2) for engaging and protecting the top end closures (62) of the plurality of containers (12), and an enclosing material (14), such as shrink wrap (14), disposed about a plurality of containers (12) having the top protective cover (2) disposed thereon for maintaining the top protective cover (2) in contact with the top end closures (62) of the containers (12).

7 Claims, 11 Drawing Figures

3
4
3
4
3
4

PROTECTIVE PACKAGING SYSTEM FOR A PLURALITY OF CONTAINERS

TECHNICAL FIELD

The present invention relates to protective packaging systems for packaging a plurality of containers. The invention more specifically relates to protective packaging systems for protecting the end panels of the top and/or bottom end closures of a plurality of containers packaged together. Even more specifically, the present invention relates to protective packaging systems for protecting the end panels of the top and/or bottom end closures of a plurality of extended shelf-life containers, such as convolute hot-fill or aseptic containers.

BACKGROUND ART

The prior art discloses many packaging systems designed for packaging a plurality of containers in six-packs or other larger groupings. However, the containers being packaged are generally ones with rigid side walls and rigid end closure members. These packaging systems are not generally concerned with packaging containers which are constructed of a paperboard laminate material with thin metal end closure structures disposed at either the top and/or bottom ends of the container, such as convolute hot-fill or aseptic extended shelf-life containers described in copending patent application Ser. No. 642,054, filed Aug. 17, 1984, of International Paper Company, the assignee of the present application.

Prior patents that disclose systems for packaging a plurality of rigid container structures which have a particular type of spacer disposed between the cans and shrink wrapping around the cans are U.S. Pat. Nos. 3,062,373 and 3,286,833. Prior patents that disclose carriers formed of a resilient deformable sheet of plastic material having lines of weakness between the individual pockets of the sheet for receiving the end closures of the rigid containers are U.S. Pat. Nos. 3,784,002, 3,300,041 and 3,202,448.

Prior patents disclosing carriers formed of a plastic material disposed over the end closures of a plurality of containers and secured underneath the edge of the chime of the end closures are U.S. Pat. Nos. 4,116,331; 3,871,669; 3,350,131; 3,346,106; 3,331,500; 3,242,631; and 3,200,944.

A prior patent disclosing a plastic carrier for packaging a plurality of containers together that is usable on cans having a beaded or unbeaded rim in U.S. Pat. No. 3,224,576. However, this patent is not concerned with the protection of the end closures or the side walls of the containers being packaged.

A prior patent disclosing a protective cover for a plurality of cans that have a chime is U.S. Pat. No. 3,224,575. The protective cover provides protection to the cans via an upwardly dished member over each container end. However, the protective cover is not configured to prevent the hydraulic effect caused by pressure on side walls of cans which could result in the outward projection of the central panels of the end closures.

Prior patents disclosing packaging systems for large numbers of cans or containers having top and/or bottom trays which engage the chimes of the end closures and further having a means to enclose the containers are U.S. Pat. Nos. 3,650,395; 3,515,272; 3,338,406; and 3,331,502.

The above cited prior art patents do not provide the features of the present invention directed to the protection of the end closures of containers from damage and outward projection due to the hydraulic effect caused by pressure on side walls. Nor are the prior patents concerned with providing a protective packaging system for containers, such as convolute hot-fill or aseptic extended shelf-life packaging containers constructed of a paperboard laminate material and having end closures that are made of a thin metallic material and heat and pressure sealed to the container as is the present invention.

DISCLOSURE OF THE INVENTION

The present invention is a protective packaging system for protecting the end closures and side walls of, for example, convolute hot-fill or aseptic extended shelf-life packaging containers from damage during shipping and handling.

In the preferred embodiment, the system of the present invention has a top protective cover for engaging the top end closures of a plurality of containers and an enclosing material which is disposed about the containers having a top protective cover disposed thereon. The enclosing material maintains the top protective cover in contact with the top end closures of the container for their protection.

The top protective cover is of unitary construction and has top member with a plurality of downwardly extending depressions disposed therein contoured to fit or lie against the top end panels of the end closures of the containers being packaged. Formed adjacent to the top edges of the depressions are grooves adapted to receive therein the top edges of the end closures of the containers engaged by the depressions. Between any cluster of three or more depressions is a downwardly extending spacer which has side walls shaped to fit or lie against the side walls and portions of the end closure extending along the side walls of the container for maintaining the proper spacing between adjacent container structures.

Circumferentially disposed from the peripheral edge of the top member is a downwardly extending flange. When the top protective cover is disposed on the end closures of the containers, the flange extends downwardly far enough to completely cover the end closures.

After the top protective cover is disposed on the plurality of containers, the enclosing material, such as shrink wrap, is disposed around the containers with the protective cover disposed thereon. The shrink wrap will cover a substantial portion of the containers and top protective cover. The shrink wrap will hold the top protective cover against the top end closures of the containers and the plurality of the containers tightly against one another. The protective packaging system so formed gives, for example, convolute hot-fill or aseptic extended shelf-life packaging containers further rigidity for protection from damage.

The protective system of the invention in a further embodiment provides for the protection of a large number of containers disposed in a carton. In this further embodiment, the protective system has a top protective cover member having a plurality of depressions disposed therein contoured to fit or lie against the the top panels of the end closures of the containers disposed in the carton. The top protective cover member is, for example, a sheet of plastic material having a plurality of depressions disposed therein with a plurality of upwardly extending members, e.g., bumps, disposed from the top of the sheet between the depressions. These upwardly extending members increase in size toward the center of the top protective cover member.

When the top protective cover member is disposed such that the depressions are disposed against the top end panels of the end closures of the containers and the carton is closed, the upwardly directed bumps engage the top of the carton. Because of the bumps, the top of the carton will bow slightly outward from its peripheral edge. This provides downward pressure on the top protective cover member to keep it against the end closures of the containers contained therein. Further, if the carton is lifted at its edges and the bottom of the container sags due to of the weight of the containers, the top of the carton will keep downward pressure on the top protective cover member because of the bumps to keep the top protective cover member in contact with the top end closures of the containers even when the carton sags.

An object of the invention is to provide a protective packaging system for a plurality of container for protecting the top end closure structures of the containers.

Another object of the invention is to provide a protective packaging system for a plurality of containers, such as convolute hot-fill and aseptic extended shelf-life packaging containers.

A further object of the invention is to provide a packaging protective system having a top protective cover disposed on the end closures of the plurality of the containers, and an enclosing member for maintaining the top protective member in contact with the top end closures of the plurality of the containers.

And even further object of the invention is to provide a package protective system which has a top protective cover which adds structural strength to thin metal end closures heat and pressure sealed to containers, and an enclosing member for maintaining the top protective member in contact with the end closures and providing rigidity to side walls of the plurality of containers.

These and other objects of the invention will be disclosed in detail in the remaining portions of the disclosure.

BEST MODE FOR CARRYING OUT THE INVENTION

Figure 1:
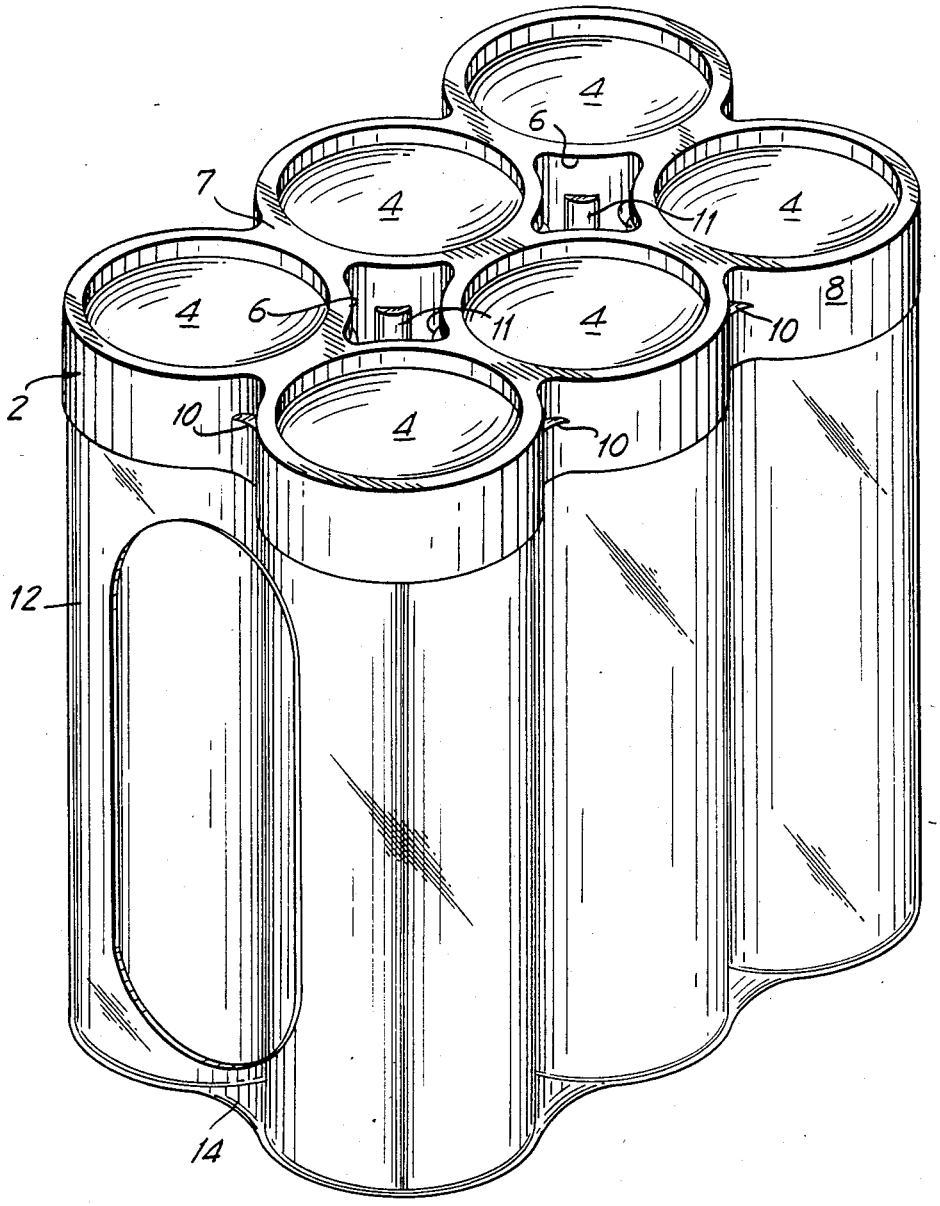
FIG. 1 shows a top perspective view of the preferred embodiment of the protective packaging system of the invention.

Referring to FIG. 1, generally at 1, the preferred embodiment of the protective packaging system of the invention is shown disposed on a plurality of containers. The protective system of the invention comprises top protective cover 2 which is adapted to be disposed on the top end closures of the plurality of containers 12, and shrink wrap 14 which is disposed about the plurality of containers 12 having top protective cover 2 disposed thereon.

Preferably, the containers that are packaged with the protection packaging system of the invention are convolute hot-filled and aseptic extended shelf-life packaging containers, as describd in co-pending patent application Ser. No. 642,054, filed Aug. 17, 1984, assigned to International Paper Company, the assignee of the present application. Although, the convolute containers are preferred, other types of containers can be packaged with the protective packaging system of the invention, e.g., spiral wound containers, plastic extrusion containers, and plastic thermoform containers. The protective packaging system of the invention is particularly adapted to engage and protect the end closure of such containers because convolute and other above-listed containers generally have their top and/or bottom end closures heat and pressure sealed to the container bodies by conventional means, e.g., heat and pressure sealing, ultrasonic sealing, induction sealing or radio frequency sealing, and a chime is not provided where the end closure mates with the end of the container body.

Figure 2:
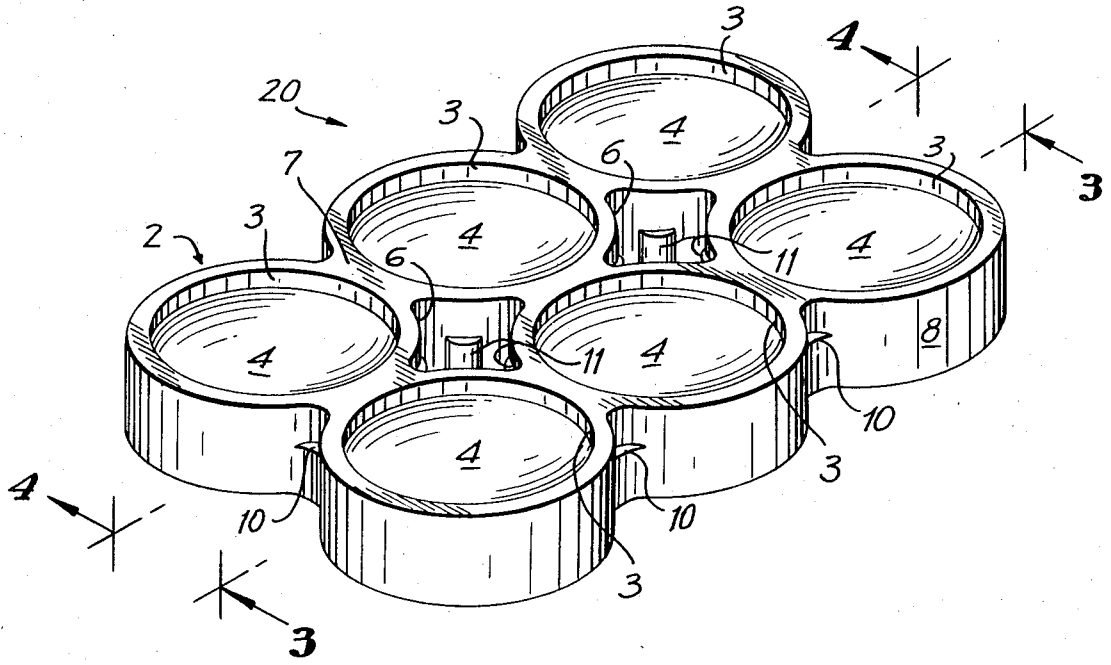
FIG. 2 shows a top protective view of the preferred embodiment of the top protective cover of the protective packaging system of the invention shown in FIG. 1.
Figure 3:
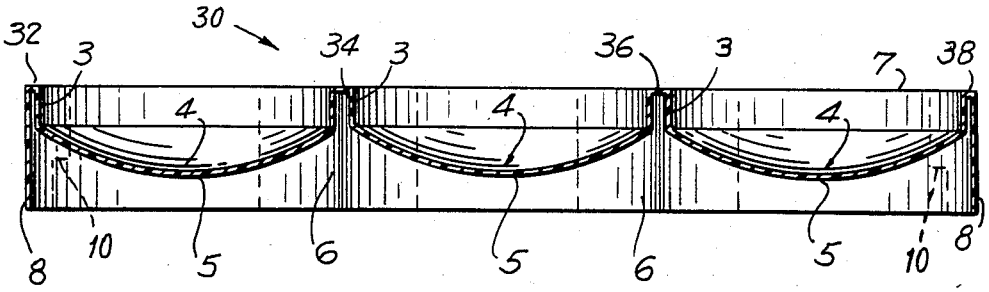
FIG. 3 shows a cross-sectional view of the preferred embodiment of the top protective cover of the protective packaging system of the invention at 3—3 of FIG. 2.
Figure 4:
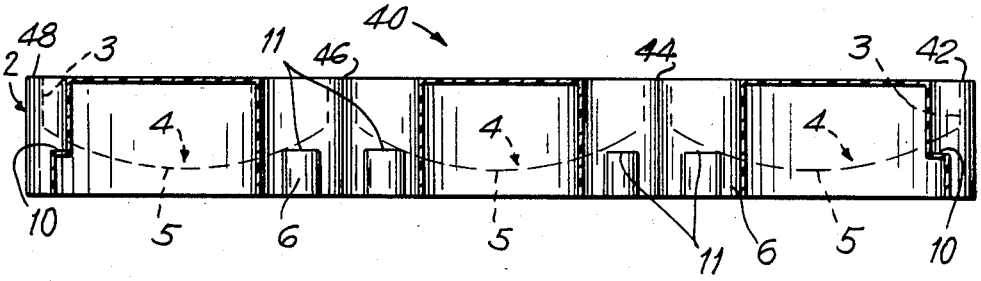
FIG. 4 shows a cross-sectional view of the preferred embodiment of the top protective cover of the protective packaging system of the invention at 4—4 of FIG. 2.

Referring to FIG. 1, generally shown at 1; FIG. 2, generally shown at 20; FIG. 3, generally shown at 30; FIG. 4, generally shown at 40; and FIG. 5, generally shown at 60, the preferred embodiment of the top protective cover will be described.

Top protective cover 2 is preferably constructed of polystyrene and has a thickness of approximately 20 mils. Although, preferably, the top protective cover is constructed of polystyrene, it is within the scope of the invention that it can be constructed of polypropylene, high density polyethylene or other suitable thermoplastic, or other material. Top protective cover 2 is preferably of unitary construction and formed by conventional means, e.g., thermoforming.

Top protective cover 2 has top member 7 with a plurality of spaced apart depressions 4 disposed therein contoured to fit or lie against the top panel of the end closures of containers 12 upon which top protective cover 2 is disposed. Each depression 4 has central member 5 and flange 3 circumferentially disposed from the peripheral edge of central member 5. Flange 3, as shown in FIGS. 2, 3, 4 and 5, is upwardly directed. Disposed between clusters of three or more depressions 4 is downwardly extending spacer 6. As shown in FIG. 2, spacer 6 when viewed from the top forms diamond shaped opening in top protective cover 2. The downwardly extending walls of spacer 6 are concave and adapted to fit or lie against the side walls and the portions of the top end closure extending along the outside surface of container 12. The inside surfaces of the side walls of spacer 6 have thereon disposed stacking lugs 11 which facilitate stacking and denesting a plurality of top protective covers, as will be described.

Although, spacer 6 is preferably formed, as described, with concave side walls, other shapes of the spacer are within the scope of the invention. In a second configuration, spacer 6 has a cylindrical shape that extends downwardly from the top protective cover. In this configuration, the side walls of the cylinder contact the side walls and portions of the end closure that extends along the side walls to provide the proper spacing between the adjacent containers.

Each depression 4 has three types of grooves associated therewith for receiving therein the top edge of the end closure of the container having disposed therein that specific depression 4. First, a groove is formed between the side wall of spacer 6 and flange 3 of depression 4, second, a groove is formed between downwardly extending flange 8 and flange 3 of depression 4, and third, between flanges 3 of immediately adjacent depressions 4. These three grooves are spaced apart around the periphery of each depression.

Downwardly extending flange 8 is circumferentially disposed around the peripheral edge of top member 7 of top protective cover 2. Flange 8 curves inwardly between adjacent depressions at the peripheral edge of top member 7. Disposed on flange 8 in the areas where flange 8 curves inwardly between adjacent depressions 4 are stacking lugs 10. Stacking lugs 10 along with stacking lugs 11 allow a plurality of top protective covers 2 to be stacked upon one another and easily denested when desired. When top protective covers 2 having stacking lugs 10 and 11 are stacked together, they are particularly adapted for denesting in automatic machines used for packaging containers in accordance with system of the invention.

Referring to FIGS. 3 and 4, cross-sectional views of top protective cover 2 at 3—3 and 4—4, respectively, of FIG. 2 are shown. In FIGS. 3 and 4, depressions 4 are shown to have the downwardly dished central members 5 having upwardly extending flanges 3 adjacent to the peripheral edge of the depressions. Although, central member 5 is shown having a downwardly dished shape, it is within the scope of the invention that the central member can have any shape that is adapted to fit or lie against the top panel of an end closure of a container being protected by a top protective cover 2. For example, in aseptic packaging containers, the top panel is substantially planar, therefore, central member 5 of depression 4 will be planar to fit or lie against such a top end panel.

Again referring to FIGS. 3 and 4, grooves 32, 38, 42 and 48 are representative of the grooves formed by flange 8 and the respective flanges 3 of depressions 4 at the peripheral edge of top member 7. These grooves are adapted to receive therein a portion of the top edge of the end closure of one container.

Grooves 34, 36, 44 and 46 are representative of the grooves formed by flanges 3 of adjacent depressions. These grooves are adapted to receive therein portions of the top edges of both of the end closures of the containers adjacently disposed.

Figure 5:
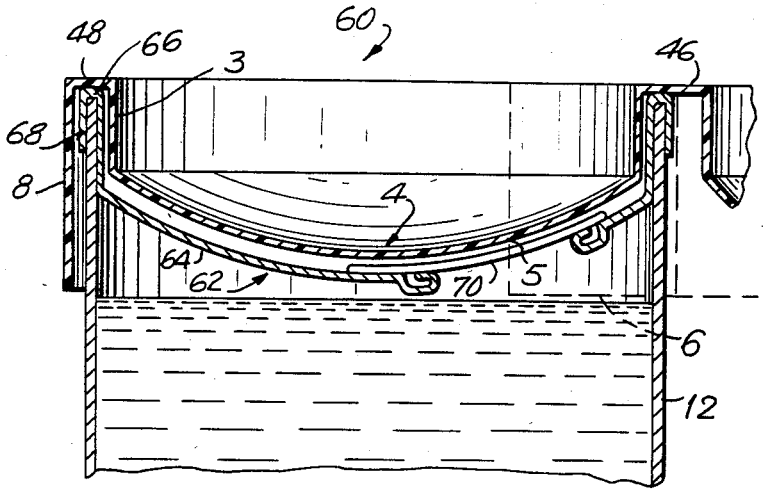
FIG. 5 shows a cross-sectional view of a portion of the top protective cover of the preferred embodiment of the protective packaging system of the invention disposed on the top end closure of a container.

Referring to FIG. 5, a cross-sectional view of a portion of the top protective cover 2 disposed on the end closure of a container is shown. Container 12 is preferably convolute hot-fill or an aseptic container constructed of a laminate paperboard structure particularly suitable for extended shelf-life packaging containers. Top end closure 62 can be constructed of a thin metallic material having a central member 64 with an opening therein covered by flexible foil closure member 70. The end closure structure has upwardly directed flange member 66 connected to sealing skirt 68. The end closure structure is disposed at the end of the container such that flange member 66 lies against inside surface of the container and sealing skirt 68 is disposed over the edge of the container body and along the outside surface. The top edge of the container body is heat and pressure sealed between flange 66 and sealing skirt 68. As shown in FIG. 5, central member 64 end closure 62 is dished inwardly, which is typical of hot-fill containers. Likewise, central member 5 of depression 4 has a shape contoured to fit or lie against inwardly dished central member 64 of end closure 62. Flange 3 of depression 4 has a height such that when the groove is formed between it and flange 8, another flange 3 of an adjacent depression, or a side wall spacer 6 (not shown), the depression will lie snugly against central member 64 of end closure 62.

Since the central member 64 of end closure 62 is constructed of a thin metallic material, central member 5 of depression 4 adds rigidity to the panel to prevent damage to it. The side walls of a convolute hot-fill or aseptic container are not rigid, as, for example, compared to the side walls of a container constructed of a metallic material. If pressure is exerted on the side walls of the convolute container, the hydraulic effect will force the top panel to flex upwardly which could either damage the seals between the closure member and the central member of the end closure, or effect the aesthetic appearance of the top end panel. By central member 5 of depression 4 lying against the top panel 64 of end closure 62, if there is pressure exerted on the side walls of the container, the depression will prevent the top panel from flexing upwardly. Also, when the packaging system of the invention is completely disposed on the plurality of containers which includes the enclosing material, the containers are held together tightly which give greater structural strength to package as a whole. Further, the protective packaging system keeps the container clean during shipping and handling.

Preferably, the enclosing material for disposition about the plurality of containers 12 having top protective cover 2 disposed thereon is shrink wrap having a thickness in the range of 1 to 1½ mils. The shrink wrap is preferably constructed of linear low density polyethylene. However, other materials such as polyvinylchloride (PVC) or other similar type materials are within the scope of the invention. Although, shrink wrap material is preferably used for enclosing the containers and top protective cover 2, other appropriate means, such as a cardboard covering or other similar type means which will hold top protective cover 2 in contact with the top end closures of the containers, can be used.

When shrink wrap 14 is disposed on the containers having top protective cover 2 disposed thereon and shrunk around the containers, there is considerable stressing of top protective cover 2 about its longitudinal center line. To prevent any detrimental effect from this stressing, top protective cover 2 is prestressed when formed. The method of prestressing of the top protective cover comprises forming the cover such that each side of the cover angles upwardly approximately 1° from the longitudinal center line. When the top protective cover is prestressed in this manner, disposed on the containers, and enclosed with the enclosing material on the containers, the top surface of top protective cover 2 becomes substantially planar, which is desirable.

Containers 12 and their end closures, and the depressions in top protective cover 2, all have circular shapes. However, it is with in the scope of this invention that the containers, their end closures, and the depressions can have others shapes, e.g., rectangular. In such a case, the depressions are adapted to fit the shape of the end closures for carrying out the objects of this invention.

Figure 6:
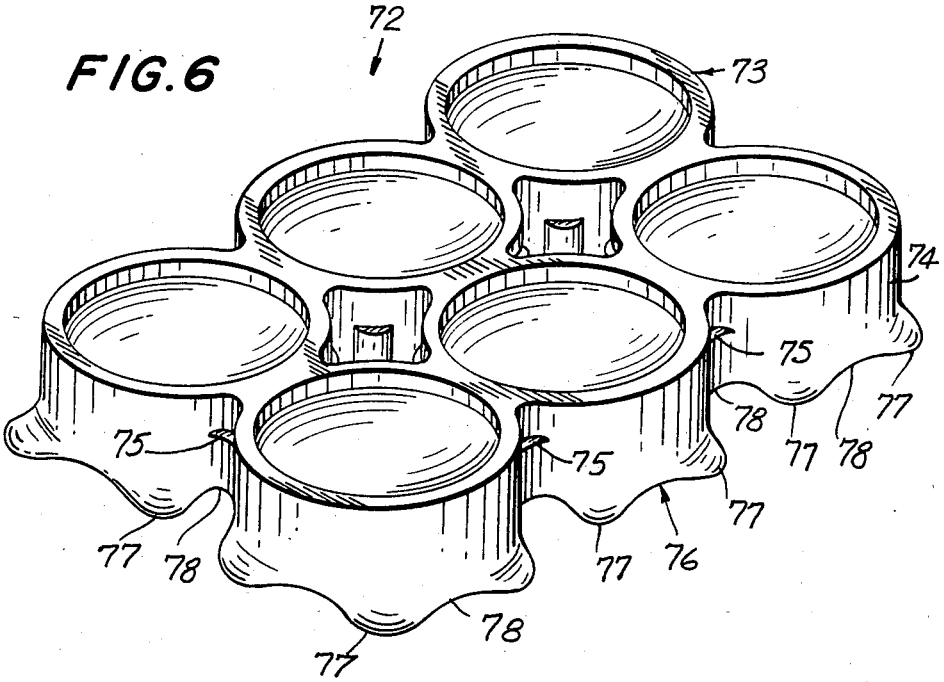
FIG. 6 shows a top perspective view of the second configuration of the top protective cover of the protective packaging system of the invention having a feature for the easy loading of the top end closures of the containers into the top protective cover.

Referring to FIG. 6, the second configuration of the top protective cover is shown generally at 72. The second configuration of the top protective cover is substantially the same as top protective 2 in the preferred embodiment, except that it has means to assist in loading the top end closures of the containers into engagement with top protective cover 73. Top protective cover 73 has a plurality spaced about depressions and spacers, as previously described for the preferred embodiment. Flange member 74 is similar to flange member 8 of the preferred embodiment, except that bottom edge 76 of flange member 74 is shaped to provide for easy loading of the top ends of the containers into top protective cover 73. Bottom edge 76 of flange 74 has an undulating shape. The bottom edge has downwardly curved portions 77 and upwardly curved portions 78. Upwardly curved portions 78 are positioned along flange 74 where top protective cover 73 when enclosed with enclosing material would contact adjacent packages if a number of packages are packed together. Downwardly curved portions 78 are disposed along the remainder portions of the bottom edge of flange 74 except beneath stacking lugs 75 which have upwardly curved portions 78 disposed thereunder. Downwardly curved portions 78 also flare slightly outward. The outward flare of downwardly curved portions 77 allow for the easy loading of the end closures of the containers into engagement with top protective cover 73.

Figure 7:
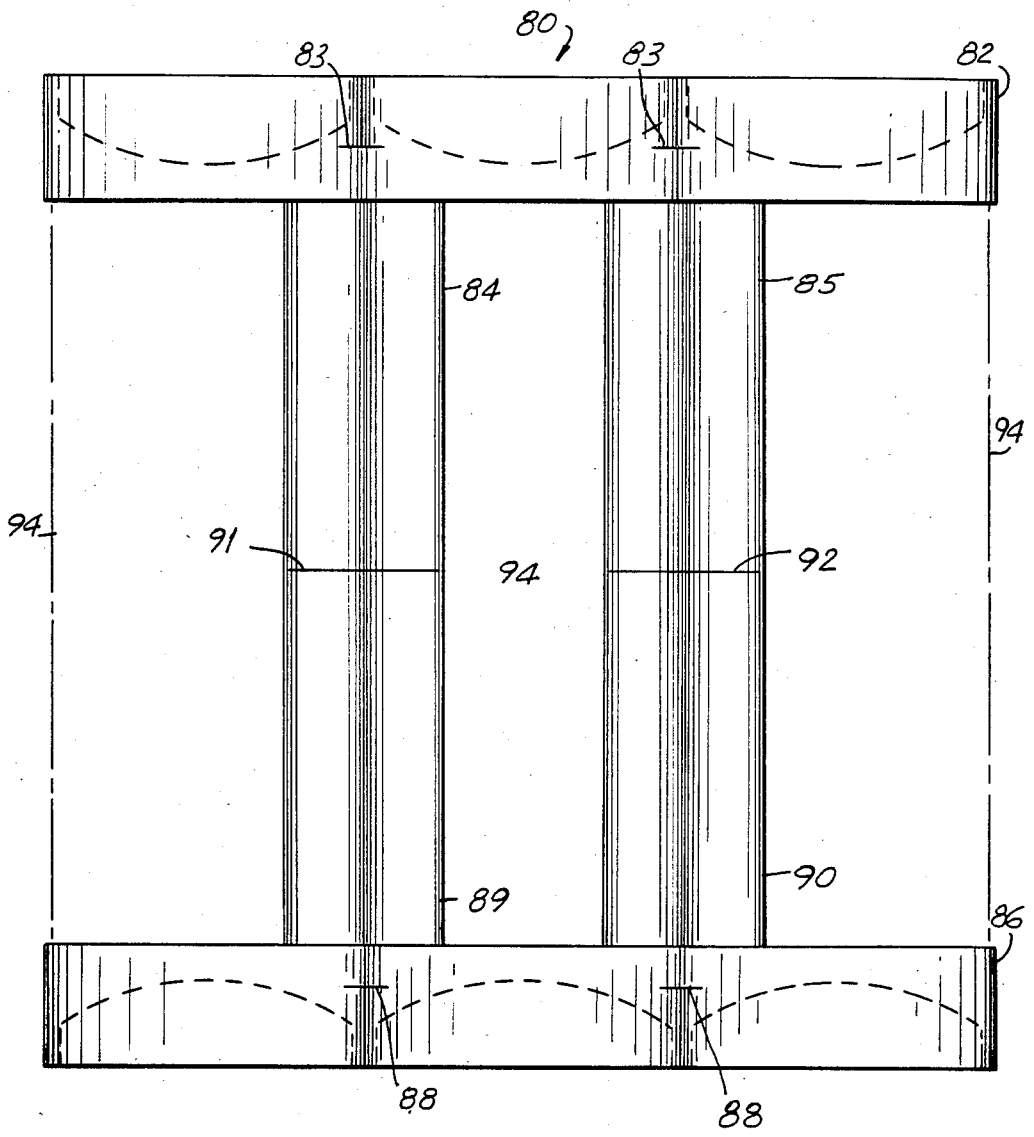
FIG. 7 shows a side view of a second embodiment of the protective packaging system of the invention.

Referring to FIG. 7, generally at 80, a side view of the second embodiment of the protective packaging system of the invention is shown.

The second embodiment of the invention comprises top protective cover 82 having integrally formed therewith post halves 84 and 85, and bottom protective cover 86 having integrally formed therewith post halves 89 and 90. Top and bottom protective covers 82 and 86 are configured substantially the same as top protective cover 2 of the preferred embodiment, except that post halves 84 and 85 extend from top protective cover 82 in place of spacers 6, and post halves 89 and 90 extend from bottom protective cover 86 in place of spacers 6. The post halves extending from the top and bottom protective covers respectively have side walls adapted to fit or lie against the side walls and portions of the top and bottom end closures extending along the outside surface of containers 94, respectively. As in the preferred embodiment, top and bottom protective covers 82 and 86, respectively, have a plurality of depressions disposed therein (shown in phantom) that are contoured to fit or lie against the top and bottom end closures, respectively, of containers 94 (shown in phantom) disposed within the packaging system. Top protective cover 82 has stacking lugs 83, and bottom protective cover 86 has stacking lugs 88 which are substantially similar to stacking lugs 10 of protective cover 2 of the preferred embodiment. Stacking lugs 83 and 88 carry out the same function as previously described for stacking lugs 10.

Top and bottom protective covers 82 and 86 are, for example, welded together by conventional means along weld lines 91 and 92 between post halves 84 and 89, and post halves 85 and 90, respectively. When the respective post halves are welded together the completed posts carry out two function. The first function is as a spacer between clusters of containers disposed in the packaging system of the invention, and the second function is connecting the top and bottom protective covers together.

The protective packaging system of the second embodiment is formed by placing containers 94 in the bottom protective cover 86 which has integrally formed therewith upwardly directed post halves 89 and 90. Once the containers are disposed in bottom protective cover 86, top protective cover 82 is disposed over the top end closures of the containers and post halves 84 and 85 are positioned between respective clusters of containers so that the ends of post halves 84 and 85 of the top protective cover abut the ends of post halves 89 and 90 of the bottom protective cover, respectively. After the respective post halves abut one another, they are welded together by conventional means to form a protective packaging system around containers 94.

In a second configuration of the second embodiment of the protective packaging system of the invention, the top and bottom protective covers 82 and 86 are formed substantially the same as top protective cover 2 of the preferred embodiment. In this configuration, the post halves 84, 85, 89 and 90 are eliminated and replaced with spacers 6. Instead of top and bottom protective covers 82 and 86 being held against the end closures of the containers by the posts formed by post halves 84 and 89, and 85 and 90, respectively, an enclosing material, such as shrink wrap, is used.

Figure 8:
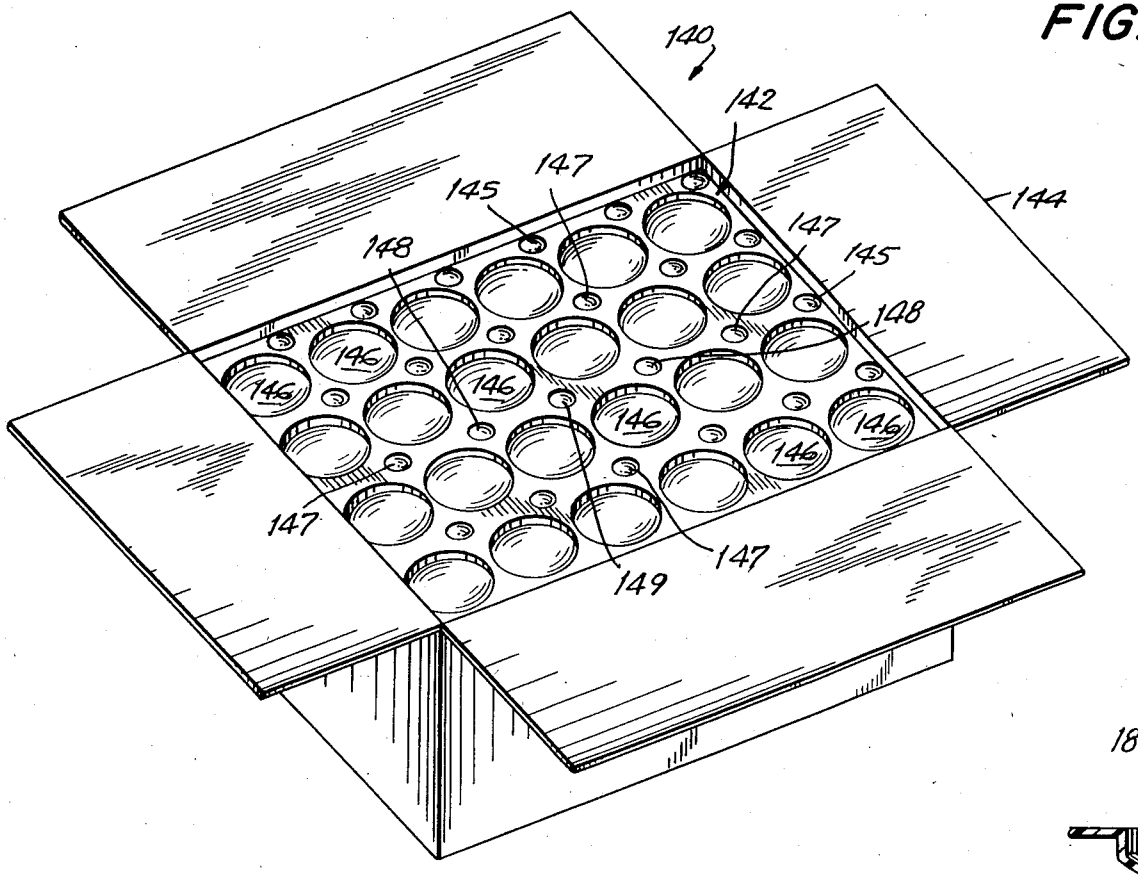
FIG. 8 shows a top perspective view of a third embodiment of the protective packaging system of the invention for containers disposed in a carton.
Figure 9:
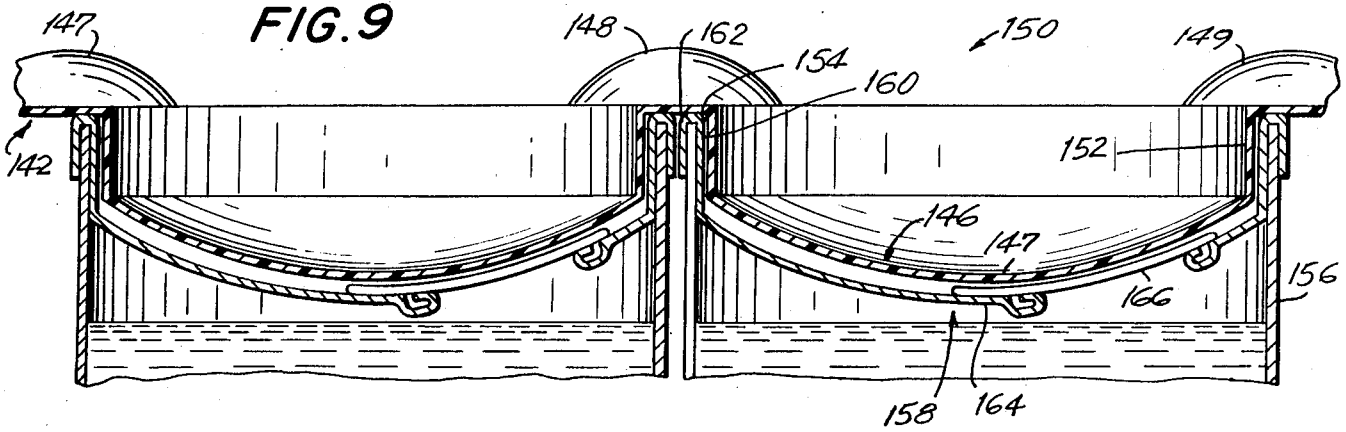
FIG. 9 shows a partial cross-sectional view of the third embodiment of the protective packaging system of the invention shown in FIG. 9.

Referring to FIG. 8, generally shown at 140; FIG. 9, generally shown at 150; and FIG. 10, generally shown at 170, the third embodiment of the protective packaging system of the invention will be described. The third embodiment of the packaging protective system of the invention is preferably usable for protecting a large number of containers disposed in a carton.

Top protective cover member 142 is disclosed on top of the containers (not shown) for their protection in shipping and handling. Top protective cover member 142 is of unitary construction. Cover member 142 has a plurality of spaced apart depressions 146 disposed therein contoured to fit or lie against the top end panel of the end closures of the containers disposed in carton 144. Top protective cover member 142 is generally constructed of thermoplastic material. However, it is within the scope of the invention that the top protective cover member 142 can be constructed of other suitable materials.

Disposed from the top surface of top protective cover member 142 in the spaces between depressions 146 are upwardly extending bumps 145, 147, 148 and 149. Although, preferably bumps are used, other structures, such as upwardly extending ridges are within the scope of the invention. The bumps disposed from the top surface of cover member 142 increase in height from the periphery of top protective cover member 142 toward the center of the cover member. The necessity of the bumps increasing in height towards the center of cover member 142 will be described subsequently.

Carton 144 which houses the containers and top protective member 142 is preferably a corrigated cardboard box. The box has a height slightly greater than the height of the containers with the top protective member 142 disposed thereon.

Referring to FIG. 9, a partial cross-sectional view of a portion of top protective cover member 142 is shown disposed on the top end closures of two containers. Top protective cover member 142 has depressions 146 having central member 147 contoured to fit or lie against panel 164 of end closure 158, in this instance, of a convolute hot-fill container. Disposed upwardly from periphery of central member 147 is circumferentially disposed upwardly directed flange 152. As shown, flange 152 has a height which is sufficient for ensuring that central member 147 of depression 146 lies against panel 164 of end closure 158. Further, flanges 152 of adjacent depressions form grooves 154 for receiving therein the top edges of adjacently disposed containers. As previously described in other embodiments, the disposition of the depressions against the top panels of the end closures adds rigidity to the top end panel to prevent their distortion should any pressure be applied to the side walls of the containers, and in general prevents damage to the top end panel.

Figure 10:
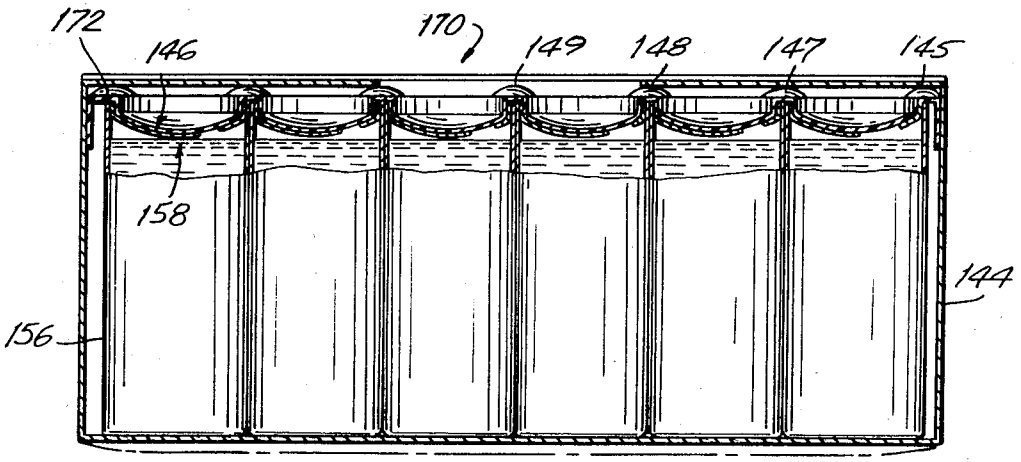
FIG. 10 shows a cross-sectional view of the third embodiment of the protective packaging system of the invention shown in FIG. 9 with the carton closed.

Disposed from top surface of top protective cover member 142 are upwardly extending bumps 145, 147, 148, and 149. These bumps increase in height toward the center of the top protective member 142, as stated. The bumps will cause the top of carton 144 to bulge slightly outward when it is closed, as shown in FIG. 10. The closed top of carton 144 provides downward pressure on top protective cover member 142 which keeps it seated on the top end closures of the containers disposed in carton 144.

When carton 144 is lifted at its ends during movement, the carton will tend to sag in the center, as shown in phantom, due to the weight of the containers within the carton. If not compensated for, the sag could cause some of the end closures and top protective cover member to separate. To compensate for the sag and keep the top protective cover member 142 in engagement with the top end closures 158 of containers 156, the protective cover member will be forced downwardly by the top of the carton because of bumps 145, 147, 148 and 149. Because of the difference in height of bumps, the center of the top protective cover member will be forced downwardly a greater distance to keep cover member 142 in contact with end closures 158 of containers 156 at the point where the carton sags the most.

Figure 11:
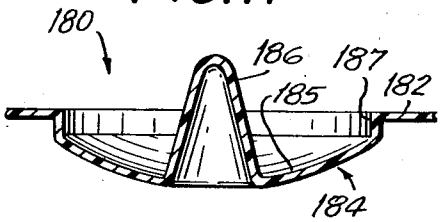
FIG. 11 shows a second configuration of the upwardly directed members for providing downward pressure on the top protective cover member of the third embodiment of the protective packaging system of the invention.

FIG. 11 shows a second configuration of the depressions in the top protective cover member in the third embodiment of the invention. In this configuration, top protective member 182 has depression 184 having central member 185 and flange 187 disposed upwardly from periphery of central member 185. Disposed from the center of central member 185 is an upwardly directing cone shaped member 186 which rises above the height of the top surface of top protective member 182. The cone shaped members increases in height above the top surface of top protective cover member 182 toward the center of protective cover member 182. When depressions 184 are formed with cone shaped members 186 extending upwardly from central members 185, the top surface of top protective member 182 does not have the series of bumps disposed therefrom, as shown in FIG. 9. Cone shaped members 186 disposed from depressions 184 carry out the same functions as the bumps previously described.

The terms and expressions which are employed herein are used as terms of description and not of limitation. And there is no intention in the use of such terms and expressions, of excluding the equivalence of the features shown, and described, it being recognized that various modifications are possible in the scope of the invention as claimed.

We claim:

1. A protective packaging system for a plurality of containers comprising a top protective cover engaging and protecting the top end closures of a plurality of containers with each container having an upper unchimed rim and a concave top end closure, each top end closure including a generally upwardly directed flange member and a generally downwardly directed sealing skirt, said flange and skirt sandwiching the upper rim of each container, an enclosing means disposed around at least a portion of the plurality of containers and the top protective cover for maintaining the top protective cover in contact with the top end closures of the containers, said top protective cover includes a plurality of spaced apart depressions disposed therein contoured and fitting against the upper surface of the end closures, a downwardly extending flange circumferentially disposed around the periphery of the top protective cover, container top end receiving grooves formed adjacent to at least a portion each depression and receiving therein at least a portion of the top edge of the end closure of an associated, and downwardly extending hollow spacers disposed from the bottom surface of the top protective cover member, the spacers having walls contoured and fitting against the sealing skirt portions of adjacent containers.

2. The system as recited in claim 1 wherein the top protective cover flange curves inwardly toward the top cover in the areas of the top cover between adjacent depressions which are adjacent to the periphery of the top member.

3. The system as recited in claim 2 wherein the top protective cover flange in the areas where it curves inwardly has thereon disposed means for stacking the top protective covers on top of one another prior to their use in the packaging system.

4. The system as recited in claim 3 wherein the top protective cover flange has means carried by the bottom edge for guiding the top edges of the containers into the receiving grooves, said means including outwardly flared and downwardly curved flange portions.

5. The system as recited in claim 4 wherein the top protective cover is of unitary construction.

6. The system as recited in claim 1 wherein each side of the top protective cover angles upwardly substantially 1° from a longitudinal center line of the top protective cover when formed.

7. The system as recited in claim 1 wherein the enclosing means includes heat shrinkable material.

* * * * *